US006308331B1

(12) United States Patent
Robak

(10) Patent No.: US 6,308,331 B1
(45) Date of Patent: Oct. 30, 2001

(54) INFLATABLE BASEBALL GLOVE

(76) Inventor: Tim Robak, 26 Deer River Rd., Columbus, NE (US) 68601

( * ) Notice: Subject to any disclaimer, the term of this patent is extended or adjusted under 35 U.S.C. 154(b) by 0 days.

(21) Appl. No.: 09/458,104

(22) Filed: Dec. 8, 1999

Related U.S. Application Data

(60) Provisional application No. 60/111,473, filed on Dec. 9, 1998.

(51) Int. Cl.[7] ..... A41D 13/08
(52) U.S. Cl. ..... 2/19; 2/161.1; 473/458
(58) Field of Search ..... 2/16, 19, 20, 161.1, 2/159; 473/458

(56) References Cited

U.S. PATENT DOCUMENTS 5,113,530 * 5/1992 Smith ..... 2/19
5,398,342 * 3/1995 Kinnee et al. ..... 2/19
5,423,088 * 6/1995 Walker et al. ..... 2/19
5,603,118 * 2/1997 Solomon ..... 2/20

* cited by examiner

*Primary Examiner*—John J. Calvert
*Assistant Examiner*—Katherine Moran
(74) *Attorney, Agent, or Firm*—John D. Gugliotta

(57) ABSTRACT

Disclosed is an inflatable baseball glove that allows the user to catch foul or home run balls while attending a baseball game in a safe and effective manner. Constructed of a plastic or rubber material similar to that used to construct inflatable beach balls, water toys and the like, the inflatable glove is inexpensive to produce, nevertheless having the durability to withstand repeated use. The rubber/plastic construction of the glove is conducive to the printing of team colors or logos thereon as a promotional, souvenir-type item.

4 Claims, 6 Drawing Sheets

INFLATABLE BASEBALL GLOVE

RELATED APPLICATIONS

The present invention was first described in Provisional Patent Application 60/111,473, filed on Dec. 9, 1998. The present application is a continuation of that prior provisional application.

BACKGROUND OF THE INVENTION

1. Field of the Invention

The present invention relates generally to baseball gloves and mitts, and more specifically to an inflatable baseball glove for use in catching foul balls and the like while attending a baseball game.

2. Description of the Related Art

Baseball is truly the great American pastime, drawing both active participation at a variety of levels and serving as entertainment for audiences across the globe. When viewing a major league baseball game in person, one of the greatest thrills that can befall a baseball lover is to catch a foul ball or, better yet, a home run. While these souvenirs are distributed routinely during every game, the odds that one will be sent the way of a single fan out of the thousands in attendance maintains this occurrence as a rarity. As a result, when one gets a chance to catch a foul ball or home run, he or she had better make the best of it as second chances do not come easy. Accordingly, many fans choose to bring along a baseball glove when attending a game just in case such an opportunity arises. Furthermore, being struck by these hard, fast moving projectiles can cause serious injuries, and the baseball glove can serve as protection therefrom. Many people, however, do not own baseball gloves and the price of a new one is extremely prohibitive. As a culmination of these contributing notions, the need has arisen for a means by which baseball fans can effectively catch foul and home run balls while protecting themselves from injuries in being struck by the same, that is inexpensive and easy to use. The present invention fulfills this need by providing an inflatable baseball glove that is lightweight and easily transported, yet effective in providing a means by which to catch a baseball or the like.

A search of the prior art did not disclose any patents that read directly on the claims of the instant invention. However, several references to conventional baseball gloves designs and other similar devices and improvements thereto were discovered. These devices neither anticipate nor disclose any embodiment that would preclude the novelty and the utilitarian functionality of the features of the present invention.

The following patents describe conventional baseball gloves that are fit with variably inflatable pneumatic bladders that serve to enhance the cushioning capacity of the glove, providing a more comfortable feel:

- U.S. Pat. No. 5,423,088, issued in the name of Walker et al.;
- U.S. Pat. No. 5,155,866, issued in the name of Walker et al.;
- U.S. Pat. No. 5,155,865, issued in the name of Walker et al.;
- U.S. Pat. No. 5,155,864, issued in the name of Walker et al.; and
- U.S. Pat. No. 5,133,530, issued in the name of Smith.

Several other related patents include:

- U.S. Pat. No. 5,768,704, issued in the name of Greenhalgh;

- U.S. Pat. No. 5,593,369, issued in the name of Stern;
- U.S. Pat. No. 5,466,202, issued in the name of Stern;
- U.S. Pat. No. 5,383,827, issued in the name of Stern;
- U.S. Pat. No. 5,257,418, issued in the name of Jaskiewicz;
- U.S. Pat. No. 4,486,975, issued in the name of Harreld et al.;
- U.S. Pat. No. 3,217,333, issued in the name of Sweet et al.; and
- U.S. Pat. No. Des. 310,255, issued in the name of Gammon.

While several features exhibited within these references may be incorporated into this invention, alone and in combination with other elements, the present invention is sufficiently different so as to make it distinguishable over the prior art.

SUMMARY OF THE INVENTION

The present invention consists of an inflatable baseball glove that allows the user to catch foul or home run balls in a safe and effective manner. Taking the form of a conventional baseball glove, the inflatable glove has an interior hand compartment contoured to receive the shape of the users hand and forms an enlarged outer surface having a padded, webbed design that creates a ball receiving or catching pocket. Constructed of a plastic or rubber material similar to that used to construct inflatable beach balls, water toys and the like, the inflatable glove is inexpensive to produce, nevertheless having the durability to withstand repeated use. An inflation valve located on the back of the wrist portion of the glove allows for manual inflation using one's mouth. The rubber/plastic construction of the glove is conducive to the printing of team colors or logos thereon as a promotional, souvenir-type item.

In an alternate embodiment, an otherwise conventional leather outer glove is provided with an inflatable interior hand compartment contoured to receive the shape of the users hand and forms an enlarged outer surface having a padded, webbed design that provides both additional fit as well as additional cushioning to a ball receiving or catching pocket. An inflation valve allows for manual inflation.

It is therefore an object of the present invention to provide an inflatable baseball glove that allows a user to safely and effectively catch foul or home run balls.

It is another object of the present invention to provide an inflatable baseball glove that creates an enlarged, webbed outer shell that forms a ball receiving or catching cavity.

It is another object of the present invention to provide an inflatable baseball glove in which an air pocket is formed between the users hand and the outer surface of the glove, thereby providing a padded layer for catching a baseball or the like.

It is another object of the present invention to provide an inflatable baseball glove that will fit the hands of a variety of users, in a one-size-fits-all manner.

It is another object of the present invention to provide an inflatable baseball glove that is constructed of a rubber or plastic material that is lightweight, strong and durable to withstand the rigors of repeated use.

Finally, It is an object of the present invention to provide an inflatable baseball glove that displays a variety of team colors and logos, creating a promotional or souvenir-type item.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

Figure 1:
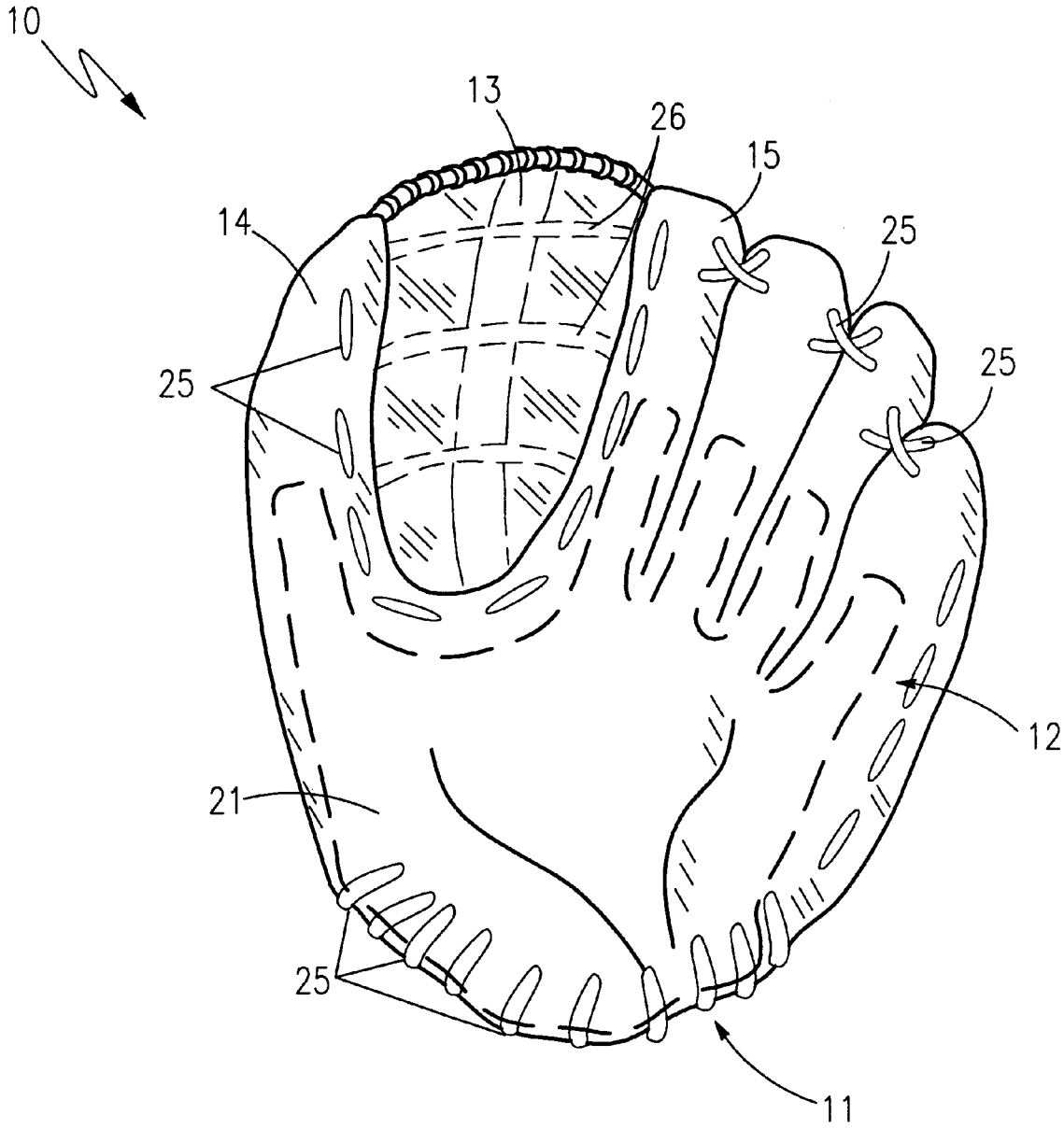
FIG. 1 is a front view of the inflatable baseball glove, according to the preferred embodiment of the present invention.
Figure 2:
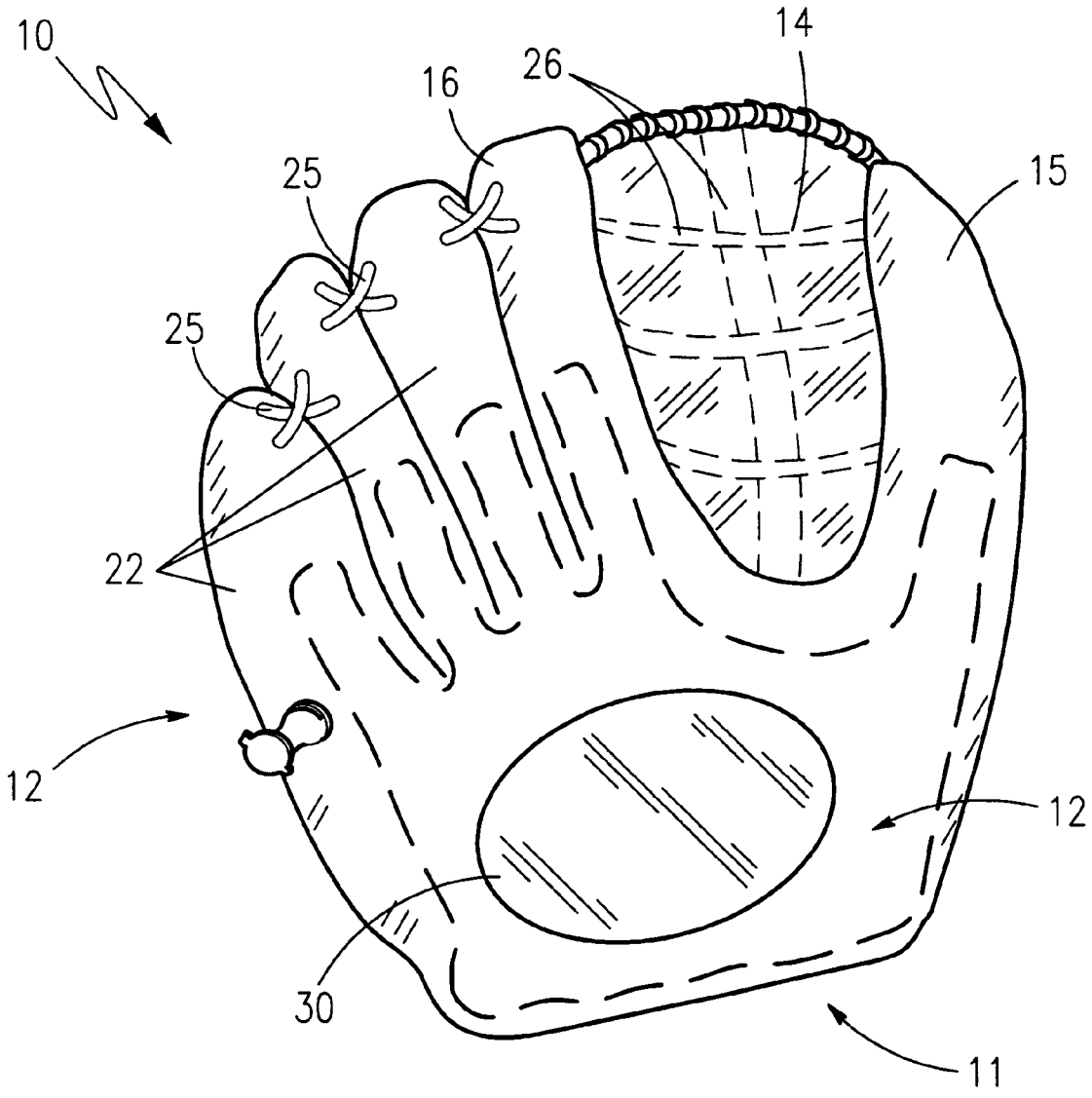
FIG. 2 is a rear view of the inflatable baseball glove, according to the preferred embodiment of the present invention.
Figure 3:
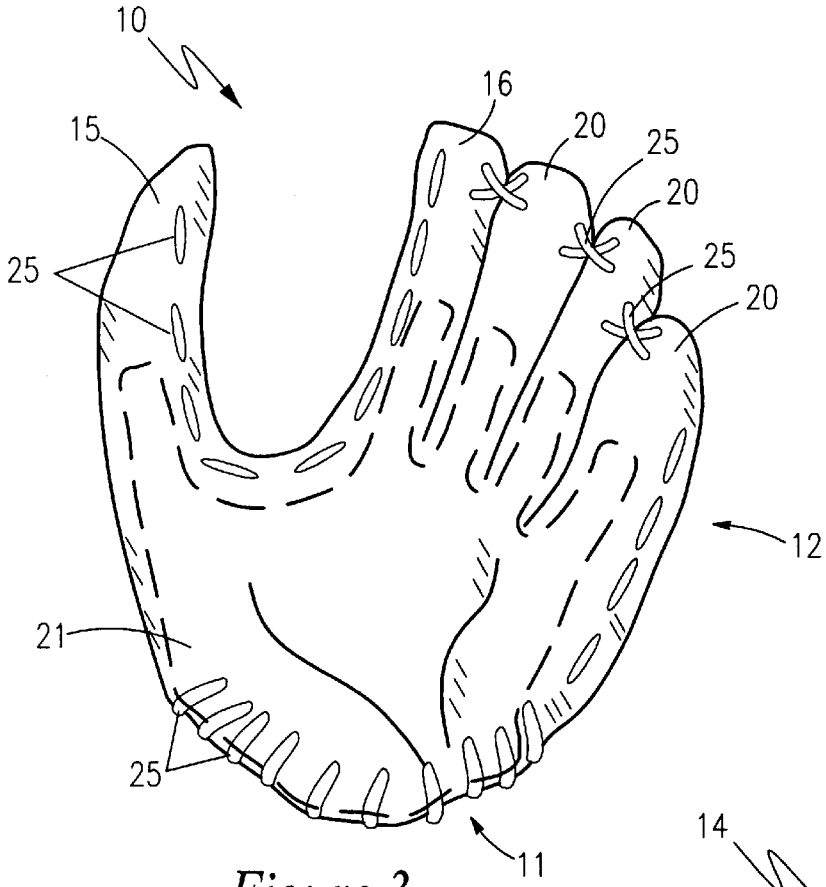
FIG. 3 is a front view of the outer shell portion of the inflatable baseball glove, according to the preferred embodiment of the present invention.

| | |
|---|---|
| 10 | Inflatable Baseball Glove |
| 11 | Inner Shell |
| 12 | Outer Shell |
| 13 | Wrist Portions |
| 14 | Basket Portion |
| 15 | Thumb |
| 16 | Forefinger |
| 20 | Air Valve |
| 21 | Palm |
| 22 | Fingers |
| 25 | False Stitching |
| 26 | False Reinforcement Straps |
| 30 | Logo |
| 35 | Hand |

DESCRIPTION OF THE PREFERRED EMBODIMENTS

1. Detailed Description of the Figures

Referring now to FIGS. 1–5, depicted is the inflatable baseball glove 10, according to the preferred embodiment of the present invention. The inflatable baseball glove 10 is constructed of a flexible rubber or plastic material having a strength and durability sufficient to withstand repeated use. In the preferred embodiment, a three-piece construction in which a glove shaped inner shell 11 inserted into a larger glove shaped outer shell 12 and sealed together along the wrist portions 13 thereof forming an airtight space therebetween. A basket portion 14 is attached to the outer shell 12 spanning between the thumb 15 and forefinger 16 portions thereof. The seals are formed by applying a heated press to adjacent materials along the wrist portions 13 of the outer shell 12 and inner shell 11 that melts the materials while compressing and bonding them together.

Although this is the preferred method of construction, it is realized that alternative methods may prove to be superior in terms of cost, quality or ease of manufacture without departing from the overall design and function of the resulting product. Accordingly, the aforementioned construction method is not intended as a limitation but rather an illustration of the preferred method.

While deflated, the inflatable baseball glove 10 can be folded for ease in storage and transportation. Inflating the glove, the user simply blows into the air valve 20 conveniently located on the back of the inflatable baseball glove 10. Once inflated, the inflatable baseball glove 10 can be worn, placing the user's hand inside the inner shell 11. The air contained between the inner shell 11 and the outer shell 12 forms a cushioning that pads the users hand, protecting it from injury upon impact by a baseball caught therein. Inflated to proper pressure, the inflatable baseball glove 10 maintains a degree of flexibility that allows the user to close the glove, drawing the thumb 15 in towards the palm 21 and fingers 22. Thus, the inflatable baseball glove 10 functions identically to that of a conventional baseball glove, allowing the user to catch a ball in the traditional manner.

The outer shell 12 and basket portion 14 of the inflatable baseball glove 10 are molded so as to mimic the characteristics typically found on conventional baseball gloves, thus enhancing its appearance. False stitching 25 is located along the wrist portion 13, between the fingers 22 and around the basket portion. The basket portion 14 itself is fitted with false reinforcement straps 26 that serve to bolster or enhance the appearance. It is also envisioned that a promotional or souvenir quality can be attached to the inflatable baseball glove 10 by affixing a logo 30, constructing it in team colors, or a combination of the two.

Figure 5:
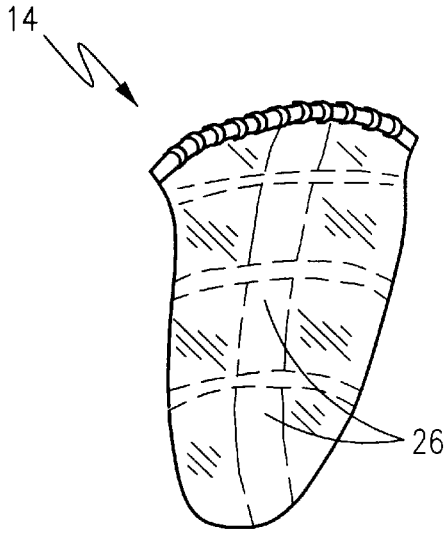
FIG. 5 is a front view of the inflatable baseball glove, according to an alternate embodiment of the present invention.
Figure 4:
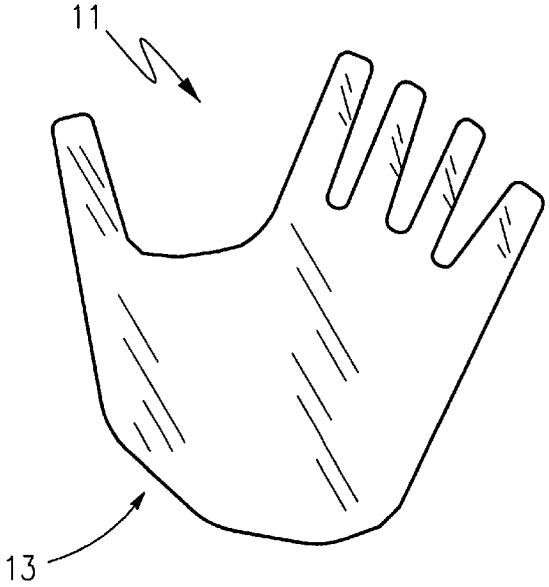
FIG. 4 is a front view of the inner shell portion of the inflatable baseball glove, according to the preferred embodiment of the present invention.
Figure 6:
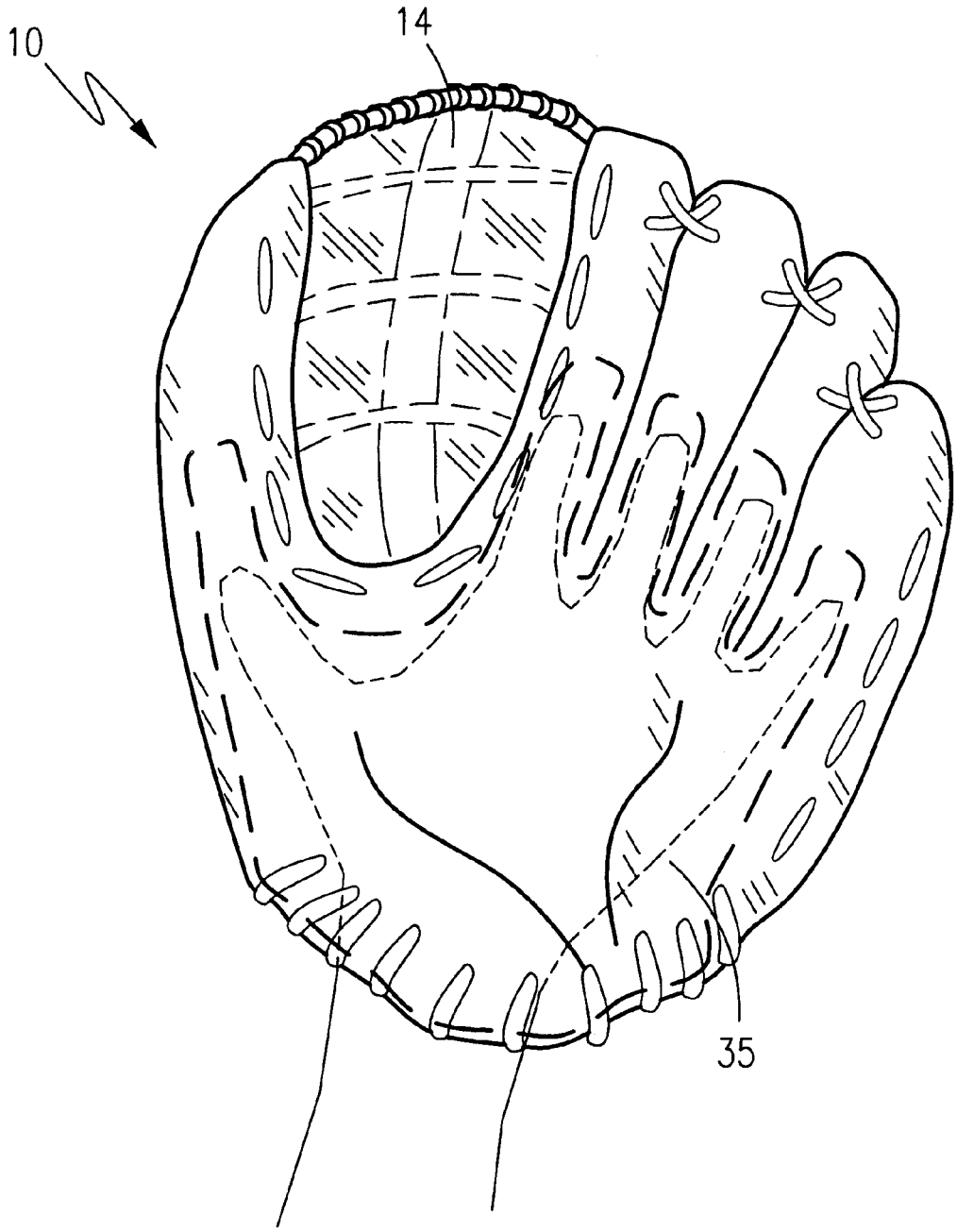
FIG. 6 is a front view basket portion of the inflatable baseball glove, according to the preferred embodiment of the present invention.

According to an alternate embodiment shown in FIG. 5, an otherwise conventional leather baseball outer glove 40 is constructed in an otherwise conventional manner, with the exception of incorporating a bladder shaped inner shell 41 inserted into the larger glove shaped outer shell 40 and sealed together along the wrist portions 43. The bladder potion 41 is attached to the outer glove 40 spanning between the thumb 45 and forefinger 46 portions thereof. Although this is the preferred method of construction, it is realized that alternative methods may prove to be superior in terms of cost, quality or ease of manufacture without departing from the overall design and function of the resulting product. Accordingly, the aforementioned construction method is not intended as a limitation but rather an illustration of the preferred method.

While deflated, the user can insert his or her hand into the glove 40 in an otherwise conventional manner. Inflating the glove, the user simply blows into the air valve 20 conveniently located on the back of the baseball glove and in fluid communication with the inner volume of the bladder. Once inflated, a cushion is formed that pads the users hand, protecting it from injury upon impact by a baseball caught therein, as well as secure the glove to the users hand in a more forceful manner.

2. Operation of the Preferred Embodiment

Figure 7:
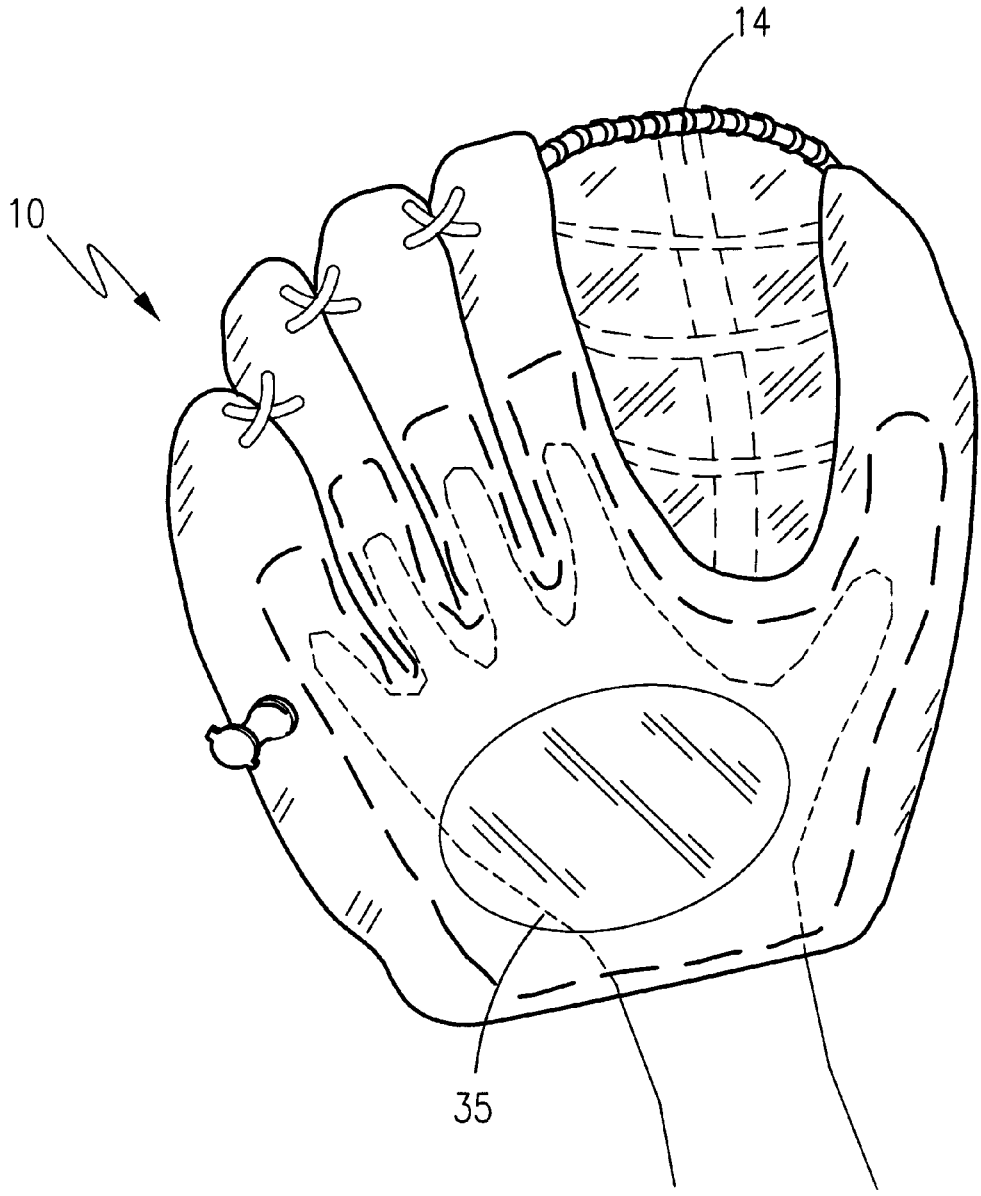
FIG. 7 is a front view of the inflatable baseball glove depicting its use, according to the preferred embodiment of the present invention.
Figure 8:
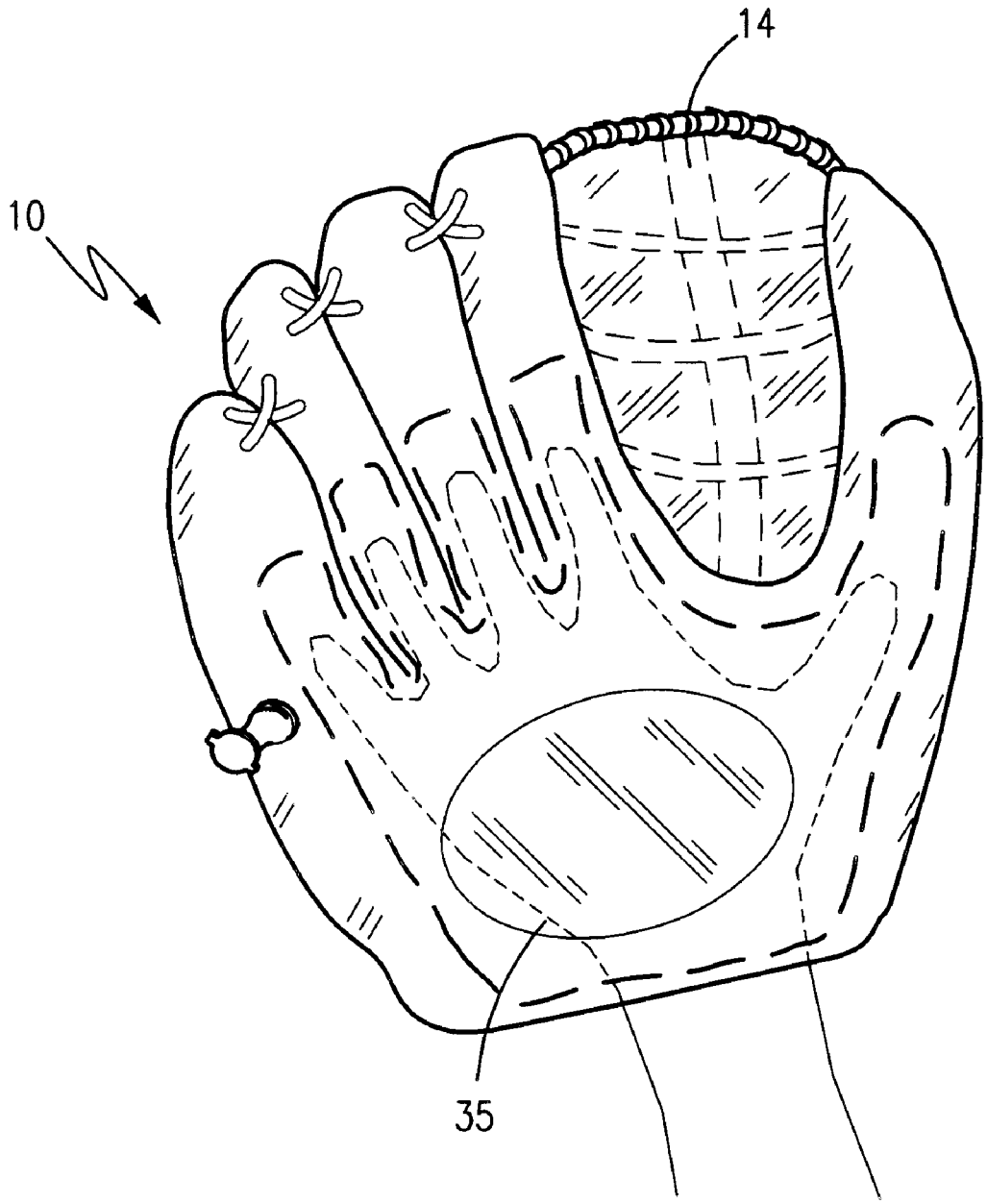
FIG. 8 is a rear view of the inflatable baseball glove depicting its use, according to the preferred embodiment of the present invention.

In accordance with the preferred embodiment of the present invention and as shown in FIGS. 7–8, the inflatable baseball glove 10 is placed on a user's hand 35 in a conventional manner. The hand 35 is inserted into the inner shell 11 of the inflated glove, the inflated nature thereof creating a tight fit for hands 35 of varying size by adjusting the degree of inflation therein. Once the glove is worn at the proper pressure, the user can catch a ball in a conventional manner, grasping it within the basket portion 14 and palm 21 thereof.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. An inflatable baseball glove comprising:

an outer shell, said outer shell further comprises a basket portion attached to the outer shell and spanning between a thumb portion and a forefinger portion;

said outer shell further comprises a wrist portion opposite said basket portion;

an inner shell inserted into said outer shell and sealed together forming an airtight space therebetween, said inner shell further comprises a wrist portion, wherein an airspace having an airtight seal is formed between said outer shell and said inner shell formed by applying a heated press to adjacent materials along the wrist portions of the outer shell and inner shell that melts the materials while compressing and bonding them together.

2. The inflatable baseball glove of claim 1, further comprising an air valve in fluid communication with the air space formed between said inner shell and said outer shell.

3. The inflatable baseball glove of claim 1, wherein:

said outer shell comprises an otherwise conventional glove shaped outer shell of a configuration similar to an otherwise conventional baseball mitt having a wrist portion and a basket portion and spanning between a thumb portion and a forefinger portion; and said inner shell forming an airtight inner bladder having an airspace.

4. A glove-shaped article comprising:

an outer glove shell having an overall glove-shaped construction and forming an outer shell interior cavity therein;

an inner glove shell having an overall glove-shaped appearance and forming an inner shell interior cavity therein, said inner glove shell being smaller in proportion to said outer glove shell, said inner glove shell being inserted inside said outer glove shell and a hermetic seal formed along said wrist portions thereof, creating said interior air space.

* * * * *